US005482617A

United States Patent [19]

Collins et al.

[11] Patent Number: 5,482,617

[45] **Date of Patent: * Jan. 9, 1996**

[54] DESULFURIZATION OF HYDROCARBON STREAMS

[75] Inventors: Nick A. Collins, Medford, N.J.; Mohsen N. Harandi, Langhorne, Pa.

[73] Assignee: Mobil Oil Corporation, Fairfax, Va.

[ * ] Notice: The portion of the term of this patent subsequent to Mar. 28, 2012, has been disclaimed.

[21] Appl. No.: 286,894

[22] Filed: Aug. 8, 1994

Related U.S. Application Data

[63] Continuation of Ser. No. 28,056, Mar. 8, 1993, abandoned.

[51] Int. Cl.[6] ..... C10G 45/12

[52] U.S. Cl. ..... 208/227; 208/208 R; 208/213

[58] Field of Search ..... 208/213, 227, 208/208 R

[56] References Cited

U.S. PATENT DOCUMENTS

| | | | |
|---|---|---|---|
| 4,090,949 | 5/1978 | Owen et al. | 208/78 |
| 4,746,762 | 5/1988 | Avidan et al. | 585/415 |
| 4,751,338 | 6/1988 | Tabak et al. | 585/415 |
| 4,753,720 | 6/1988 | Morrison | 208/135 |
| 4,778,661 | 10/1988 | Avidan et al. | 422/146 |
| 4,827,069 | 5/1989 | Kushnerick et al. | 585/415 |
| 4,855,521 | 8/1989 | Avidan et al. | 585/415 |
| 4,950,387 | 8/1990 | Harandi et al. | 208/49 |
| 4,992,607 | 2/1991 | Harandi et al. | 585/467 |
| 5,171,425 | 12/1992 | Muller | 208/213 |

OTHER PUBLICATIONS

"Industrial Application of Shape Selective Catalysis", Chen et al., Catal. Rev.–Sci. Eng. 28(2&3), 247–249 (1986).

*Primary Examiner*—Helane Myers
*Attorney, Agent, or Firm*—A. J. McKillop; M. D. Keen

[57] ABSTRACT

A process for desulfurizing a hydrocarbon stream which includes at least 50 ppmw sulfur in the form of organic sulfur compounds, and $C_5$+ hydrocarbons including benzene. The hydrocarbon stream is contacted in the absence of added hydrogen with a fluidized bed of an acidic catalyst having a structure of ZSM-5, ZSM-11, ZSM-22, ZSM-23, ZSM-35, ZSM-48, MCM-22, MCM-36, MCM-49, zeolite Y, zeolite beta or mixtures thereof to convert the organic sulfur compounds to hydrogen sulfide. The catalyst contacts the hydrocarbon stream at a pressure of from 0.0 psig to about 400 psig, a temperature of from about 400° F. to about 900° F., and a weight hourly space velocity of from about 0.1 $hr.^{-1}$ to about 10.0 $hr.^{-1}$. Thereafter, the hydrogen sulfide is removed from the hydrocarbon stream.

25 Claims, No Drawings

DESULFURIZATION OF HYDROCARBON STREAMS

This is a continuation of Ser. No. 028,056, filed Mar. 8, 1993, now abandoned.

BACKGROUND OF THE INVENTION

1. Field of the Invention

The present invention relates to the desulfurization of hydrocarbon streams. More specifically the present invention relates to desulfurization of hydrocarbon streams by converting organic sulfur compounds in the streams to hydrogen sulfide without added hydrogen.

2. Description of Prior Art

The production of high octane gasoline continues to be a major objective of refinery operations worldwide. The phase-out of lead and the movement to reformulate gasoline to improve air quality in the United States, Europe, and the Pacific Rim countries present a major challenge and opportunity in the refining industry. In the United States, the recent Clean Act Amendments define reformulated gasoline in terms of composition including oxygen, benzene, Rvp and total aromatics, and of performance standards containing reductions in VOC's and air toxics. More stringent requirements may be required in the future as indicated by California Air Resources Board proposals for tighter limitations on gasoline olefins, sulfur, Rvp, and distillation curve. In Europe, movements are underway to reduce allowable benzene from the current guideline of 5 vol % maximum. An interim reduction to 3% has been proposed. Also, sulfur may be restricted to 200 ppmw in Eurograde gasoline. In the Pacific Rim countries, octane shortfall may occur as lead additives are phased out, and several countries are considering reducing the amount of allowable benzene in gasoline. Japan now limits the amount of sulfur in gasoline to 150 ppmw or less. However, conventional desulfurization technologies consume hydrogen or require caustic wash placing additional burdens on these limited refinery resources.

Typically hydrotreating is used to convert sulfur compounds in hydrocarbon streams or fractions to hydrogen sulfide for removal from the fraction. Hydrotreating is also used to improve stability by saturating olefinic compounds in the stock being treated. Hydrotreating also may be employed to improve the quality of feed streams to other units such as naphtha reformers and cat crackers or product streams such as jet fuels and distillates. Hydrotreating of heavier crude fractions is also used to improve the quality of FCC feedstocks and to remove sulfur from residual fuel oil fractions.

Specifically, hydrotreating of FCC feedstocks may be considered as feed preparation and/or as a pollutant cleanup process, and is generally associated with improved product selectivity and product quality in cracking. Thus, higher conversion and gasoline yield, and lower selectivity to coke have commonly been reported in FCC cracking of hydrogenated stocks. Also, more favorable light gas distribution, including higher isobutane yields, has been observed. Improved quality of cracked products, ranging from gas through coke, notably in lower sulfur and nitrogen contents, allows meeting ultimate $SO_2$ and $NO_x$ specifications.

More specifically, hydrotreating converts asphaltenes and potential coke-forming material and saturates polynuclear aromatic ring systems so that less coke is formed upon cracking. Much of the hydrogen consumption in hydrotreating can be related to saturation of polynuclear aromatics, and sulfur and nitrogen heterocyclics.

A hydrotreating process is generally carried out in a fixed bed single pass adiabatic reactor with feed preheat, hydrogen-recycle/compression and cooling quench capabilities, and feed effluent heat exchange capacity. Typically, the required auxiliary apparatus are high and low pressure separators, fractionators, and access to amine scrubbers to remove hydrogen sulfide and mercaptans. A supply of $H_2$ may be cascaded from a catalytic reformer, but high hydrogen-consumption dictates construction of a hydrogen plant.

Sulfur is removed catalytically by hydrogenation of heterocyclic aromatic rings in which it is located. In lighter fractions, mild conditions may suffice for desulfurization. However, with heavier oils, the sulfur is deeply buried in the hydrocarbon, and a mild catalytic cracking is required to extract it.

Processing residua for fuels is especially difficult if large amounts of asphaltenes are present. These high molecular weight, often colloidal aggregates, are highly aromatic and tend to coke up catalysts. Their sulfur and metals are difficult to remove, and much hydrogen is consumed in their processing.

The prior art provides no simple alternative to these basic hydrogenative cleanup processes which require a capital intensive hydrogen plant, a hydrotreating reactor and other associated equipment.

SUMMARY OF THE INVENTION

In accordance with a broad aspect of the present invention, there is provided a process for desulfurizing a hydrocarbon feed stream which comprises at least 50 ppmw sulfur in the form of organic sulfur compounds. The process comprises the steps of contacting the hydrocarbon stream in the absence of added hydrogen with an acidic catalyst to convert organic sulfur compounds to hydrogen sulfide, and then removing the hydrogen sulfide from the hydrocarbon stream. The catalyst is preferably in a fluidized bed.

The hydrocarbon feed stream may contain an olefin component, along with aromatic components including benzene. The olefin component which may range from $C_1$ to $C_{10}$ typically derives light olefins ($C_1$–$C_4$), if present, from LPG and /or fuel gas. Heavier olefins, if present, are generally obtained from cracking processes, such as catalytically cracked naphthas or pyrolysis or coker gasolines. The sources of the aromatic components including benzene are $C_5$+ naphtha, FCC gasoline, reformate and thermally cracked pyrolysis and/or coker fractions.

The feed stream may contain both aromatic and olefin components in a fraction of a single origin. For example, an FCC process may provide the light olefin component of $C_4$– olefins, as well as a catalytically cracked $C_5$+ fraction including both the heavier olefinic and the aromatic components. The catalytically cracked $C_5$+ fraction contains at least 50 ppmw of the organic sulfur compounds, and may contain at least 200 ppmw of such organic sulfur compounds.

In accordance with a specific aspect of the invention, the acidic catalyst is a zeolite having a structure of ZSM-5, ZSM-11, ZSM-12, ZSM-22, ZSM-23, ZSM-35, ZSM-48, MCM-22, MCM-36, MCM-49, zeolite Y, zeolite beta or mixtures thereof.

In accordance with another aspect of the invention, the hydrocarbon stream contacts the acidic catalyst at a pressure of from 0.0 psig to about 400 psig, and preferably from about 50 psig to about 250 psig; at a temperature of from about 400° F. to about 900° F.; and at a weight hourly space velocity of from about 0.1 $hr.^{-1}$ to about 10.0 $hr^{-1}$ and preferably from about 0.1 $hr.^{-1}$ to about 2.0 $hr.^{-1}$.

Thus, the present invention provides an alternative method for desulfurization which can complement existing desulfurization facilities, and reduce capital expenditure on new or modified processes.

DESCRIPTION OF SPECIFIC EMBODIMENTS

HYDROCARBON FEED STREAM

The hydrocarbon feed stream processed by the present invention preferably contains an olefin component, along with aromatic components including benzene. The olefin component which may range from $C_1$ to C10 typically derives light olefins ($C_1$–$C_4$), if present, from LPG and/or fuel gas. Heavier olefins, if present, are generally obtained from FCC gasoline or other naphthas derived from cracking processes. These olefin-containing fractions typically have the following properties.

| FRACTION | IP | EP | SULFUR CONTENT |
|---|---|---|---|
| LPG | −100° F. | 100° F. | 1–1,000 ppmw |
| fuel gas | — | — | 0–100 ppmw |
| FCC gasoline | 70° F. | 450° F. | 50–50,000 ppmw |

The sources of the aromatic component including benzene are straight run naphtha, FCC gasoline, reformate and/or thermally cracked pyrolysis and coker fractions. These fractions generally have an IP and EP of 70° F. and 450° F., respectively, and the following noted sulfur content.

| FRACTION | SULFUR CONTENT |
|---|---|
| straight run naphtha | 5–5,000 ppmw |
| FCC gasoline | 50–5,000 ppmw |
| reformate | 0.0–10 ppmw |
| thermally cracked- | |
| pyrolysis gasoline | 50–5,000 ppmw |
| coker | 50–5,000 ppmw |

The feed stream may contain both aromatic and olefin components in a fraction of a single origin. For example, a fluid catalytic cracking (FCC) process may provide the light olefin component of $C_4$–olefins. The FCC gasoline stream includes a catalytically cracked $C_5$+ fraction including both the olefinic and aromatic components. The catalytically cracked $C_5$+ fraction contains at least 50 ppmw of the organic sulfur compounds, and may contain at least 200 ppmw of said organic sulfur compounds.

The $C_5$+ hydrocarbon stream may also comprise $C_5$+ reformate (e.g. a 150°–210° F. fraction rich in benzene), pyrolysis gasoline, coker naphtha or combinations thereof.

In addition to desulfurization, the process of the present invention may provide significant olefin and benzene conversion and octane uplift. This conversion occurs as a result of the alkylation of benzene with olefins.

The FCC naphtha fractions may be upstream or downstream of a mercaptan extractor such as the extractive Merox process developed by Universal Oil Products and described in Modern Petroleum Technology, 4th Ed, G. D. Hobson et al, Applied Science Publishers LTD, Essex, England, 1973, pages 392–396. A fluid-bed reactor/regenerator is preferred to maintain catalyst activity.

Process Parameters

In accordance with another aspect of the invention, the hydrocarbon feed stream contacts a fluid bed of the acidic catalyst at a pressure of from 0.0 psig to about 400 psig, preferably from about 50 psig to about 250 psig; and at a temperature of from about 400° F. to about 900° F., preferably from about 700° F. to about 850° F. for ZSM-5, ZSM-11, ZSM-22, ZSM-23, ZSM-35 and ZSM-48. The preferred temperature range for MCM-22, MCM-36, MCM-49, zeolite Y and zeolite beta is from about 400° F. to about 800° F. The weight hourly space velocity of the stream is from about 0.1 $hr^{-1}$ to about 10.0 $hr^{-1}$ and preferably from about 0.1 $hr^{-1}$ to about 2.0 $hr^{-1}$.

It is preferred that the process of the present invention remove at least 30%, and more preferably at least 50%, of the organic sulfur compounds from the fuel gas feed stream.

Catalyst

The acidic catalyst used in the desulfurization process of the present invention is preferably a zeolite-based catalyst, that is, it comprises an acidic zeolite in combination with a binder or matrix material such as alumina, silica, or silica-alumina. The preferred zeolites for use in the catalysts in the present process are the medium pore size zeolites, especially those having the structure of ZSM-5, ZSM-11, ZSM-12, ZSM-22, ZSM-23, ZSM-35, ZSM-48 MCM-22. The medium pore size zeolites are a well-recognized class of zeolites and can be characterized as having a Constraint Index of 1 to 12. Constraint Index is determined as described in U.S. Pat. No. 4,016,218 incorporated herein by reference. Catalysts of this type are described in U.S. Pat. Nos. 4,827,069 and 4,992,067 which are incorporated herein by reference and to which reference is made for further details of such catalysts, zeolites and binder or matrix materials.

The present process may also use catalysts based on large pore size zeolites such as the synthetic faujasites, especially zeolite Y, preferably in the form of zeolite USY. Zeolite beta may also be used as the zeolite component. Other materials of acidic functionality which may be used in the catalyst include the materials identified as MCM-36 (described in U.S. patent applications Ser. Nos. 07/811,360, filed 20 Dec. 1991 and 07/878,277, filed 4 May 1992) and MCM-49 (described in U.S. patent applications Ser. Nos. 07/802,938 filed 6 Dec. 1991 and 07/987,850, filed 9 Dec. 1992). These applications describing MCM-36 and MCM-49 are incorporated herein by reference.

The particle size of the catalyst should be selected in accordance with the fluidization regime which is used in the process. Particle size distribution will be important for maintaining turbulent fluid bed conditions as described in U.S. Pat. No. 4,827,069 and incorporated herein by reference. Suitable particle sizes and distributions for operation of dense fluid bed and transport bed reaction zones are described in U.S. Pat. Nos. 4,827,069 and 4,992,607 both incorporated herein by reference. Particle sizes in both cases will normally be in the range of 10 to 300 microns, typically from 20 to 100 microns.

Thus, the preferred acidic zeolite catalysts are those exhibiting high hydrogen transfer activity and having a zeolite structure of ZSM-5, ZSM-11, ZSM-12, ZSM-22, ZSM-23, ZSM-35, ZSM-48, MCM-22, MCM-36, MCM-49, zeolite Y, and zeolite beta.

These catalysts are capable of converting organic sulfur compounds such as thiophenes and mercaptans to hydrogen sulfide without added hydrogen by utilizing hydrogen present in the hydrocarbon feed. Metals such as nickel may be used as desulfurization promoters.

These catalysts are also capable of simultaneously converting light olefins present in the fuel gas to more valuable gasoline range material. A fluid-bed reactor/regenerator is preferred over a fixed-bed system to maintain catalyst activity. Further, the hydrogen sulfide produced in accordance with the present invention can be removed using conventional amine based absorption processes such as those discussed hereinabove.

ZSM-5 crystalline structure is readily recognized by its X-ray diffraction pattern, which is described in U.S. Pat. No. 3,702,866. ZSM-11 is disclosed in U.S. Pat. No. 3,709,979, ZSM-12 is disclosed in U.S. Pat. No. 3,832,449, ZSM-22 is disclosed in U.S. Pat. No. 4,810,357, ZSM-23 is disclosed in U.S. Pat. Nos. 4,076,842 and 4,104,151, ZSM-35 is disclosed in U.S. Pat. No.4,016,245, ZSM-48 is disclosed in U.S. Pat. No. 4,375,573 and MCM-22 is disclosed in U.S. Pat. No. 4,954,325. The U.S. Patents identified in this paragraph are incorporated herein by reference.

While suitable zeolites having a coordinated metal oxide to silica molar ratio of 20:1 to 200:1 or higher may be used, it is advantageous to employ aluminosilicate ZSM-5 having a silica:alumina molar ratio of about 25:1 to 70:1, suitably modified. A typical zeolite catalyst component having Bronsted acid sites may consist essentially of crystalline aluminosilicate having the structure of ZSM-5 zeolite with 5 to 95 wt.% silica, clay and/or alumina binder.

These siliceous zeolites are employed in their acid forms, ion-exchanged or impregnated with one or more suitable metals, such as Ga, Pd, Zn, Ni, Co and/or other metals of Periodic Groups III to VIII. The zeolite may include other components, generally one or more metals of group IB, IIB, IIIB, VA, VIA or VIIIA of the Periodic Table (IUPAC).

Useful hydrogenation components include the noble metals of Group VIIIA, especially platinum, but other noble metals, such as palladium, gold, silver, rhenium or rhodium, may also be used. Base metal hydrogenation components may also be used, especially nickel, cobalt, molybdenum, tungsten, copper or zinc.

The catalyst materials may include two or more catalytic components which components may be present in admixture or combined in a unitary multifunctional solid particle.

In addition to the preferred aluminosilicates, the gallosilicate, ferrosilicate and "silicalite" materials may be employed. ZSM-5 zeolites are particularly useful in the process because of their regenerability, long life and stability under the extreme conditions of operation. Usually the zeolite crystals have a crystal size from about 0.01 to over 2 microns or more, with 0.02–1 micron being preferred.

In the following Examples, the fluidized bed catalyst particles consist essentially of 25 wt % H-ZSM-5 zeolite, based on total catalyst weight, contained within a silica-alumina matrix and having a alpha value of 5. Sulfur conversion to hydrogen sulfide will increase as the alpha value increases.

In a fixed bed embodiment the catalyst may consist of a standard 70:1 aluminosilicate H-ZSM-5 extrudate having an acid value of at least 20, preferably 150 or higher.

The Alpha Test is described in U.S. Pat. 3,354,078, and in the *Journal of Catalysis*, Vol. 4, p. 527 (1965); Vol. 6, p. 278 (1966); and Vol. 61, p. 395 (1980), each incorporated herein by reference as to that description.

EXAMPLES

In Example 1 of the instant invention, a $C_5$-215° F. FCC naphtha cut was passed over ZSM-5 in a laboratory scale fluid-bed reactor which provided significant sulfur conversion to hydrogen sulfide. As shown in Table 1, up to 61% of the sulfur in the $C_5$-215° F. FCC naphtha cut was converted to hydrogen sulfide over ZSM-5 at 750° F. and 75 psig with no hydrogen cofeed.

TABLE 1

Example 1 - Desulfurization of Light FCC Gasoline

| Operating Conditions | | | |
|---|---|---|---|
| Time on Stream, Hrs | Feed | 2.5 | 8 |
| Temperature, °F. | — | 750 | 750 |
| Pressure, psig | — | 75 | 75 |
| Total HC WHSV, $hr^{-1}$ | — | 1.0 | 1.0 |
| Catalyst Activity, Alpha | — | 5 | 5 |
| Feed Sulfur, ppmw | 200 | 200 | 200 |
| $H_2S$ in Offgas, ppmv | — | 1200 | 1200 |
| Sulfur Conv. to $H_2S$, % | — | 61 | 46 |

In Example 2 reported in Table 2, 51% of the sulfur contained in a mixed feed containing LPG, pyrolysis gasoline and light reformate was converted to hydrogen sulfide over ZSM-5 catalyst in a laboratory scale fluid-bed reactor at 800° F. and 190 psig.

TABLE 2

Example 2 - Pygas/Lt. Reformate/LPG Desulfurization

| Operating Conditions | | | |
|---|---|---|---|
| Time on Stream, hours | Feed | 3.5 | 8.5 |
| Temperature, °F. | — | 800 | 800 |
| Pressure, psig | — | 190 | 190 |
| Total HC WHSV, $hr^{-1}$ | — | 2.5 | 2.5 |
| Catalyst Activity, Alpha | — | 5 | 5 |
| LPG Sulfur, ppmv | | | |
| $CH_3SH$ | 450 | 450 | 450 |
| COS | 10 | 10 | 10 |
| Pygas/Lt. Ref. Sulfur, ppmw | 79 | 79 | 79 |
| $H_2S$ in Offgas, ppmv | — | 510 | 500 |
| Sulfur Conv. to $H_2S$, % | — | 51 | 51 |

In addition to converting naphtha sulfur without added hydrogen, the process of the present invention may convert benzene in reformate and in FCC gasoline to higher octane alkylaromatics using olefin cofeed. The process may also reduce FCC gasoline olefin content and Rvp; and upgrade fuel gas or propene/butene streams to gasoline.

The process of the instant invention operates in a dense fluid bed reactor and regenerator system using standard commercial air supply and catalyst handling equipment. Associated equipment for product recovery and for fractionation in this process depends on the degree of integration with existing refinery operations and existing towers. The catalyst (e.g. ZSM-5) activity is maintained by withdrawing a slipstream from the reactor inventory and regenerating with air. Catalyst with low carbon is returned back to the reactor. The heat of combustion may be removed by flue gas and excess air, or by cooling coils. Thermal energy from the circulating catalyst provides part of the hydrocarbon feed preheat. The regenerator flue gas can be mixed into the FCC regenerator flue gas.

The reactor and regenerator operating temperatures are mild compared to FCC conditions. Expensive alloys or refractory linings are not required in the design. Operating pressure is designed to be compatible with existing FCC unsaturated gas plant pressure. Direct transfer of FCC offgas to the unit of the present invention is preferred, avoiding the added cost of a compressor. FCC off gas needs only to go through a fuel gas amine contactor to remove hydrogen sulfide.

As discussed above, the versatility of the process in a refinery extends beyond its sulfur reduction and octane uplift/benzene reduction potential.

Examples 3 to 6 are runs with FCC Naphtha/heart-cut reformate feeds demonstrating benzene, olefin and Rvp reduction benefits with these feeds. Example 3 is a run with 215° F. FCC Naphtha at a pressure of 75 psig, temperature of 750° F., total hydrocarbon feed WHSV of 1.0 $hr^{-1}$ over ZSM-5 in a laboratory scale fluid-bed reactor.

Example 4 is a run with 50/50 v/v of 215° F. FCC Naphtha/190° F. Heart-cut reformate at a pressure of 75 psig., temperature of 800° F., total hydrocarbon feed WHSV of 1.5 $hr^{-1}$ over ZSM-5 in a laboratory scale fluid-bed reactor.

Example 5 is a run with 75/75 v/v 215° F. FCC Naphtha/190° F. Heart-cut reformate at a pressure of 75 psig, temperature of 800° F., total hydrocarbon feed WHSV of 1.0 $hr^{-1}$ over ZSM-5 in a laboratory scale fluid-bed reactor.

Example 6 is a run with full range FCC Naphtha at a pressure of 75 psig, temperature of 850° F. and a total hydrocarbon feed WHSV of 1.5 $hr^{-1}$ over ZSM-5 in a laboratory scale fluid-bed reactor.

Table 3 provides detailed feedstock compositions, and Table 4 feedstock properties for the feeds of Examples 3–6. Table 5 summarizes each run of Examples 3–6, and Table 6 provides desulfurization data on the runs. Table 7 provides detailed sulfur conversion data for the run of Example 6 with a full range FCC Naphtha.

As shown in Table 6, each run of Examples 5–8 provide a substantial percentage of desulfurization ranging from 16% for Example 6 to a high of 56% for Example 5. Percentage of desulfurization being defined as the amount of $H_2S$ sulfur in the process effluent divided by the amount of sulfur in the feed.

TABLE 3

| | Detailed Feedstock Compositions | | | |
|---|---|---|---|---|
| Example | 3 | 4 | 5 | 6 |
| Feedstock | 215° F. FCC | 50/50 v/v 215° F. FCC/ 190° F. HCR* | 75/25 v/v 215° F. FCC/ 190° F. HCR* | Full-Range FCC |
| Composition, wt % | | | | |
| N-Butane | 0.86 | 0.24 | 0.35 | 0.27 |
| Isobutane | 0.42 | 0.09 | 0.13 | 0.15 |
| 1=Iso-Butene | 1.04 | 0.26 | 0.37 | 0.34 |
| Cis-2-Butene | 1.21 | 0.38 | 0.55 | 0.49 |
| Trans-2-Butene | 1.26 | 0.37 | 0.54 | 0.48 |
| N-Pentane | 3.51 | 2.48 | 2.84 | 1.02 |
| Isopentane | 11.39 | 5.35 | 7.42 | 5.05 |
| 1-Pentene | 1.91 | 0.84 | 1.23 | 0.79 |
| Cis-2-Pentene | 2.50 | 1.16 | 1.70 | 1.19 |
| Trans-2-Pentene | 4.40 | 2.02 | 2.96 | 2.04 |
| 2-Methyl-1-Butene | 3.33 | 1.48 | 2.17 | 1.43 |
| 3-Methyl-1-Butene | 0.55 | 0.22 | 0.32 | 0.21 |
| 2-Methyl-2-Butene | 6.28 | 2.94 | 4.32 | 2.92 |
| Pentadienes | 0.19 | 0.11 | 0.14 | 0.08 |
| Cyclopentane | 0.54 | 1.27 | 0.95 | 0.19 |
| N-Hexane | 3.10 | 9.65 | 6.63 | 0.58 |
| 2-Methylpentane | 6.57 | 10.05 | 8.65 | 3.18 |
| 3-Methylpentane | 3.77 | 7.56 | 5.98 | 1.86 |
| 2,2-Dimethylbutane | 0.05 | 0.94 | 0.55 | 0.02 |
| 2,3-Dimethylbutane | 1.53 | 2.20 | 2.03 | 0.83 |
| Hexanes | 14.77 | 8.13 | 11.55 | 7.67 |
| Methylcyclopentane | 3.28 | 2.34 | 2.86 | 1.53 |
| Cyclohexane | 0.33 | 0.20 | 0.28 | 0.12 |
| Benzene | 2.29 | 21.18 | 13.66 | 2.21 |
| Total $C_7^+$ | 24.92 | 18.58 | 21.83 | 65.35 |
| $C_7$–$C_9$ N-Paraffins | 0.83 | 0.97 | 0.96 | 1.31 |
| $C_7$–$C_9$ Isoparaffins | 6.80 | 7.72 | 7.66 | 8.31 |
| $C_7$–$C_9$ Olefins | 10.51 | 4.90 | 7.10 | 3.67 |
| $C_7$–$C_9$ Naphthenes | 3.13 | 1.79 | 2.55 | 9.69 |
| $C_7$–$C_9$ Aromatics | 3.53 | 3.15 | 3.46 | 25.29 |
| $C_{10}^+$ & Unknowns | 0.12 | 0.05 | 0.10 | 17.08 |

*Heart-cut reformate

TABLE 4

| Example | Feedstock Properties 3 | 4 | 5 | 6 |
|---|---|---|---|---|
| Feedstock | 215° F. FCC | 50/50 v/v 215° F. FCC/ 190° F. HCR* | 75/25 v/v 215° F. FCC/ 190° F. HCR* | Full-range FCC |
| Total Feed Sulfur | | | | |
| ppmw | 242 | 125 | 170 | — |
| wt % | 0.020 | 0.021 | 0.022 | 0.19 |
| Mercaptan Sulfur ppmw | 3 | — | — | 18 |
| Feed Nitrogen ppmw | 7 | <1 | 5 | 84, 76 |
| Research Octane | 91.0 | 86.7 | 87.8 | 92.4 |
| Motor Octane | 79.7 | 79.1 | 79.6 | 81.1 |
| Sim. Distillation °F. | | | | |
| 1/5 wt % off | −52/53 | 66/74 | 43/73 | 39/61 |
| 10/20 wt % off | 74/95 | 96/129 | 90/103 | 93/120 |
| 40/60 wt % off | 109/149 | 148/177 | 137/163 | 194/272 |
| 80/90 wt* off | 181/213 | 183/198 | 188/211 | 333/378 |
| 95/99 wt % off | 230/254 | 224/241 | 230/251 | 405/430 |
| Calculated $C_5$+ Properties | | | | |
| RON/MON | 90.4/79.2 | 86.5/79.4 | 87.5/79.4 | 92.2/81.0 |
| Molecular Weight | 82.2 | 83.0 | 82.9 | 99.3 |
| Density @ 60° F., g/ml | 0.68 | 0.73 | 0.70 | 0.75 |
| Reid Vapor Pressure, psi | 9.9 | 7.4 | 8.3 | 5.9 |

*Heart-cut reformate

TABLE 5

| Example | Summary of Runs with FCC Naphtha Feeds 3 | | 4 | | 5 | | 6 | |
|---|---|---|---|---|---|---|---|---|
| Feedstock | 215° F. FCC | | 50/50 v/v 215° F. FCC/ 190° F. HCR* | | 75/25 v/v 215° F. FCC/ 190° F. HCR* | | Full-Range FCC | |
| Pressure, psig | 75 | | 75 | | 75 | | 75 | |
| Temperature, °F. | 750 | | 800 | | 800 | | 850 | |
| Feed WHSV, $hr^{-1}$ | | | | | | | | |
| $C_2$–$C_9$ Olefin | 0.48 | | 0.34 | | 0.33 | | 0.41 | |
| Total HC | 1.0 | | 1.5 | | 1.0 | | 1.5 | |
| Feed Benzene/ $C_2$–$C_9$ Olefins | | | | | | | | |
| mol/mol | 0.05 | | 0.94 | | 0.42 | | 0.09 | |
| wt/wt | 0.05 | | 0.93 | | 0.41 | | 0.08 | |
| Material Balance No. | 1 | 2 | 1 | 2 | 1 | 2 | 1 | 2 |
| Hrs. on Stream | 2.5 | 8 | 2 | 7.5 | 2.8 | 8.5 | 2.3 | 6.3 |
| $C_2$–$C_9$ Olefin Conv, % | 73 | 55 | 64 | 50 | 76 | 62 | 46 | 23 |
| Benzene Conv, % | 10 | 14 | 32 | 30 | 44 | 43 | 20 | 20 |
| N-Hexane Conv, % | 9 | 7 | 31 | 28 | 42 | 33 | −79 | −66 |
| ($C_5^+$ Product-$C_5^+$ Feed PNA)/ Feed $C_2$–$C_9$ Olefins, wt % | 62 | 69 | 51 | 45 | 42 | 48 | 54 | 65 |
| $C_5^+$ Product/$C_5^+$ Feed | | | | | | | | |
| wt % | 85 | 88 | 90 | 88 | 82 | 84 | 88 | 92 |
| vol % | 81 | 85 | 87 | 85 | 77 | 79 | 84 | 89 |
| $\Delta C_5^+$ RON | +0.6 | +0.8 | +2.5 | +2.4 | +2.8 | +2.6 | +1.8 | +1.1 |
| $\Delta C_5^+$ MON | +2.9 | +2.9 | +3.8 | +3.1 | +3.4 | +3.0 | +1.8 | +1.7 |
| $\Delta C_5^+$ RVP, psi | −1.8 | −1.6 | −1.0 | −0.9 | −1.3 | −1.2 | −0.6 | −0.7 |

*Heart Cut Reformate

TABLE 6

| Desulfurization Data | | | | | | | | |
|---|---|---|---|---|---|---|---|---|
| Example | 3 | | 4 | | 5 | | 6 | |
| Feedstock | 215° F. FCC | | 50/50 v/v 215° F. FCC/ 190° F. HCR* | | 75/25 v/v 215° F. FCC/ 190° F. HCR* | | Full-Range FCC | |
| Total Feed Sulfur | | | | | | | | |
| ppmw | 242 | | 125 | | 170 | | — | |
| wt % | 0.020 | | 0.021 | | 0.022 | | 0.040, 0, 19 | |
| wt % | — | | — | | — | | 0.176 | |
| Mercaptan Sulfur ppmw | 3 | | — | | — | | 18 | |
| Sulfur as $H_2S$ ppmw | 2 | | — | | — | | — | |
| Material Balance No. | 1 | 2 | 1 | 2 | 1 | 2 | 1 | 2 |
| Hrs. on Stream | 2.5 | 8 | 2 | 7.5 | 2.8 | 8.5 | 2.3 | 6.3 |
| Offgas $H_2S$ ppmw | 1200 | 1200 | 900 | 1100 | 900 | 1100 | 6600 | 8800 |
| TLP** Sulfur ppmw | 111 | 170 | 60 | 78 | 72 | 97 | — | — |
| wt % | — | — | — | — | — | — | 0.14 | 0.16 |
| Spent Cat. Sulfur, Wt % | 0.045 | | 0.035 | | 0.040 | | 0.050 | |
| Sulfur Closure, % | | | | | | | | |
| ($H_2S$ + TLP Sulfur) Feed Sulfur | 88 | 100 | 77 | 103 | 90 | 109 | 88 | 96 |
| ($H_2S$ + TLP + Cat. Sulfur)/Feed Sulfur | 103 | 114 | 90 | 115 | 106 | 122 | 89 | 98 |
| Desulfurization, % | | | | | | | | |
| $H_2S$ Sulfur/Feed Sulfur | 50 | 38 | 33 | 44 | 56 | 57 | 20 | 16 |
| (Feed Sulfur-TLP Sulfur)/Feed Sulfur*** | 54 | 30 | 52 | 38 | 58 | 43 | 26 | 16 |

*Heart Cut Reformate
**Total Liquid Product
***Does not include concentration effect due to gas make which higher desulfurization values.

TABLE 7

| Detailed Sulfur Conversion Data | | |
|---|---|---|
| Example | 8 | |
| Feedstock | Full-Range FCC | |
| Material Balance Number | Feed | 1 |
| Hours on Steam | — | 2.3 |
| TLP* Yield, wt % | — | 92.0 |
| Sulfur, wt % | 0.19 | 0.14 |
| Sulfur Distribution, wt % | | |
| Unknown Sulfurs | — | 4.96 |
| Thiophene | 6.52 | 4.08 |
| 2+3-Methylthiophenes | 17.53 | 11.14 |
| 2+3-Ethylthiophenes | 16.21 | 12.32 |
| Unknown Thiophenes | 5.10 | 3.36 |
| $C_3$-Thiophenes | 12.36 | 11.26 |
| $C_4^+$-Thiophenes | 4.50 | 5.44 |
| Benzothiophene | 31.34 | 35.70 |
| Unknown Benzothiophenes | 1.65 | 2.86 |
| Methylbenzothiophenes | 3.50 | 6.50 |
| $C_2$-Benzothiophenes | 1.29 | 2.39 |
| Conversion, % | | |
| Thiophene | — | 58 |
| 2+3-Methylthiophenes | — | 57 |
| 2+3-Ethylthiophenes | — | 48 |
| $C_3$-Thiophenes | — | 38 |
| Total Thiophenes | — | 48 |

TABLE 7-continued

| Detailed Sulfur Conversion Data | | |
|---|---|---|
| Example | 8 | |
| Benzothiophene | — | 23 |
| Total Benzothiophenes | — | 15 |

*Total Liquid Product

While the invention has been described in conjunction with specific embodiments thereof, it is evident that many alternatives, modifications, and variations will be apparent to those skilled in the art in light of the foregoing description. According, it is intended to embrace all such alternatives, modification, and variations as fall within the spirit and broad scope of the appended claims.

What is claimed is:

1. A process for desulfurizing a hydrocarbon stream including at least 50 ppmw sulfur in the form of organic sulfur compounds, comprising the steps of:

contacting said hydrocarbon stream in the absence of added hydrogen with an acidic catalyst in a single fluidized bed at a temperature of from about 700° F. to about 850° F., a pressure from 0 to 400 psig and a space velocity from 0.1 to 10 $hr^{-1}$ WHSV, to convert said organic sulfur compounds to hydrogen sulfide; and removing said hydrogen sulfide from said hydrocarbon stream.

2. The process of claim 1 wherein said hydrocarbon stream comprises a catalytically cracked $C_5$+ fraction including olefinic and aromatic components produced by catalytic cracking, further comprising removing hydrogen sulfide from said hydrocarbon steam prior to the removing step.

3. The process of claim 1 wherein said hydrocarbon stream contains at least 200 ppmw of sulfur in the form of said organic sulfur compounds.

4. The process of claim 1 wherein said hydrocarbon stream comprises (1) a light olefin component including $C_4$–olefins, and (2) a $C_5$+ hydrocarbon fraction including benzene.

5. The process of claim 4 wherein said light olefin component contains at least 1 00 ppmw sulfur in the form of said organic sulfur compounds.

6. The process of claim 4 wherein said light olefin component is produced by a fluid catalytic cracking process.

7. The process of claim 4 which includes the step of removing hydrogen sulfide from the light olefin stream prior to contacting the stream with the acidic catalyst and with the $C_5$+ hydrocarbon fraction.

8. The process of claim 1 wherein said hydrocarbon stream comprises a catalytically cracked $C_5$+ fraction.

9. The process of claim 8 wherein said catalytically cracked $C_5$+ fraction contains at least 50 ppmw of sulfur in the form of said organic sulfur compounds.

10. The process of claim 9 wherein said catalytically cracked $C_5$+ fraction contains at least 200 ppmw sulfur in the form of said organic sulfur compounds.

11. The process of claim 1 wherein said $C_5$+ hydrocarbon stream comprises a $C_5$+ reformate.

12. The process of claim 11 wherein said $C_5$+ reformate is a 150° F.–210° F. fraction rich in benzene.

13. The process of claim 1 wherein said $C_5$+ hydrocarbon stream comprises a pyrolysis gasoline.

14. The process of claim 13 wherein said pyrolysis gasoline contains at least 50 ppmw sulfur in the form of said organic sulfur compounds.

15. The process of claim 14 wherein said pyrolysis gasoline contains at least 200 ppmw of sulfur in the form of said organic sulfur compounds.

16. The process of claim 1 wherein said zeolite comprises an intermediate pore size zeolite.

17. The process of claim 16 wherein said intermediate pore size zeolite has the structure of ZSM-5.

18. The process of claim 16 wherein said intermediate pore size zeolite has the structure of ZSM-5, ZSM-11, ZSM-22, ZSM-23, ZSM-35, ZSM-48, MCM-22 or mixtures thereof.

19. The process of claim 1 wherein said zeolite comprises a large pore size zeolite.

20. The process of claim 19 wherein said zeolite comprises zeolite Y or zeolite beta.

21. The process of claim 1 wherein said hydrocarbon steam is contacted with said catalyst at a pressure of from 50 psig to about 250 psig.

22. The process of claim 1 wherein said hydrocarbon stream is contacted with said catalyst at a space velocity from about 1.0 WHSV to about 5.0 WHSV.

23. The process of claim 1 wherein at least 30% of said organic sulfur compounds are removed from said hydrocarbon stream.

24. The process of claim 23 wherein at least 50% of said organic sulfur compounds are removed from said hydrocarbon stream.

25. A process for desulfurizing a hydrocarbon stream including at least 50 ppmw sulfur in the form of organic sulfur compounds, a light olefin component including $C_4$-olefins, and $C_5$+ hydrocarbons including benzene comprising the steps of:

(a) removing hydrogen sulfide from said hydrocarbon stream;

(b) then contacting said hydrocarbon stream in the absence of added hydrogen with a single fluidized bed of an acidic catalyst having a structure of ZSM-5, ZSM-11, ZSM-22, ZSM-23, ZSM-35, ZSM-48, MCM-22, MCM-36, MCM-49, zeolite Y, zeolite beta or mixtures thereof to convert said organic sulfur compounds to hydrogen sulfide; said catalyst contacting said hydrocarbon stream at a pressure of from 0.0 psig to about 400 psig, a temperature of from about 400° F. to about 900° F., and a weight hourly space velocity of from about 0.1 $hr.^{-1}$ to about 10.0 $hr.^{-1}$; and (c) removing hydrogen sulfide produced in step (b) from said hydrocarbon stream.

* * * * *